US006211610B1

(12) United States Patent
Nakajima

(10) Patent No.: US 6,211,610 B1
(45) Date of Patent: Apr. 3, 2001

(54) COLOR CATHODE RAY TUBE WITH FIRST AND SECOND MAGNETIC COMPENSATORS

(75) Inventor: Kouji Nakajima, Shiga (JP)

(73) Assignee: NEC Corporation, Tokyo (JP)

( * ) Notice: Subject to any disclaimer, the term of this patent is extended or adjusted under 35 U.S.C. 154(b) by 0 days.

(21) Appl. No.: 09/115,651

(22) Filed: Jul. 15, 1998

(30) Foreign Application Priority Data

Jul. 15, 1997 (JP) ..... 9-189368

(51) Int. Cl.[7] ..... H01J 29/76
(52) U.S. Cl. ..... 313/440; 313/442; 335/212
(58) Field of Search ..... 313/440, 442; 335/211, 212

(56) References Cited

U.S. PATENT DOCUMENTS 4,386,331 * 5/1983 Kohzuki et al. ..... 335/211
4,794,300 * 12/1988 Beelaard et al. ..... 313/440

FOREIGN PATENT DOCUMENTS 55-157846 12/1980 (JP) ..... H01J/29/76
61-269835 11/1986 (JP) .
2-129835 5/1990 (JP) .
8-115686 5/1996 (JP) ..... H01J/29/76
9-45261 2/1997 (JP) ..... H01J/29/76
96-918 1/1996 (KR) .

OTHER PUBLICATIONS

JP 09045261 A; H. Sato; abstract, Feb. 1997.*
H. Sato, "Deflection Yoke Device," Translation of JP patent No. 09045261, pp 1–16, Feb. 1997.*

* cited by examiner

*Primary Examiner*—Michael H. Day
(74) *Attorney, Agent, or Firm*—McGinn & Gibb, PLLC

(57) ABSTRACT

A cathode ray tube including (a) a panel having a fluorescent film on an inner surface thereof for three primary colors emission, (b) an electron gun for emitting electron beams to the fluorescent film, (c) a deflecting yoke located between the panel and the electron gun, and including first and second coils for generating horizontally and vertically deflected magnet fields, (d) at least one first compensator (34) composed of magnetic substance having high magnetic permeability and low hysteresis characteristic for compensating for a profile of magnetic flux density in the horizontally deflected magnetic field, and (e) at least one second compensator (35) composed of magnetic substance having hysteresis characteristic for keeping magnetization when a polarity of the horizontally deflected magnetic field is inverted. The first compensator compensates for misconvergence generated between a central electron beam and two electron beams between which the central electron beam is situated, and the second compensator compensates for misconvergence generated between the two electron beams. Thus, misconvergence is readily compensated for, ensuring qualified images on a screen.

15 Claims, 10 Drawing Sheets

COLOR CATHODE RAY TUBE WITH FIRST AND SECOND MAGNETIC COMPENSATORS

BACKGROUND OF THE INVENTION

1. Field of the Invention

The invention relates to a color cathode ray tube including an in-line type electron gun, and in particular, a color cathode ray tube which is capable of readily compensating for misconvergence.

2. Description of the Related Art

First, a structure of a conventional color cathode ray tube is explained below with reference to FIG. 1. The illustrated color cathode ray tube includes a bulb 1 comprised of a panel 1*b,* a neck portion 1*c,* and a funnel 1*a,* which has a truncated-conical cross-section and connects the panel 1*b* and the neck portion with each other.

A fluorescent filter film 2 is applied to an inner surface of the panel 1*b.* The flourescent film 2 includes flourescent materials for emission of three primary colors, which are separated from one another with photo-absorbing material sandwiched between them.

An in-line type electron gun 3 is installed in the neck portion 1*c* for emitting three electron beams to the flourescent film 2 to cause emission of three primary colors.

A deflecting yoke 4 is secured to the bulb 1 over the funnel portion 1*a* and the neck portion 1*c.* The deflecting yoke 4 is comprised of a bobbin 5 having a truncated-conical cross-section, a first coil 6 wound around the bobbin 5 for horizontally deflecting a magnetic field, a second coil 7 wound around the bobbin 5 for vertically deflecting a magnetic field, and a ferrite core 8 applied on an outer surface of the bobbin 5.

Though not illustrated, the color cathode ray tube further includes an inner shield in the funnel portion 1*a,* a shadow mask facing the flourescent film in the funnel portion 1*a,* and an aid such as a purity magnet in the neck portion 1*c.*

During operation, the electron gun 3 horizontally emits and accelerates three parallel electron beams, and deflects two other electron beams, between which a central electron beam is situated in such a manner that those two electron beams converge to the central electron beam.

Sawtooth current is supplied to each of the first and second coils 6 and 7, generating horizontally and vertically deflected magnetic fields.

The three electron beams emitted from the electron gun 3 enter the deflected magnetic fields, and are deflected to a degree proportional to the intensity of the magnetic fields. These three deflected electron beams are converged onto the flourescent film 2 to emit lights. As a result, colored images appear on the panel 1*b.*

In order to produce colored images having no color-misregistration, the three electron beams must be correctly directed to associated color regions in the fluorescent film 2.

However, it is quite difficult to make the deflected magnetic fields completely symmetrical in the bulb 1 because of a dispersion in the shape in the windings of the first and second coils 6 and 7, a dispersion in location of the first and second coils 6 and 7 when secured to the bobbin 5, a dispersion in the axis of the electron gun in the neck portion 1*c,* and/or a gap between axes of the deflecting yoke 4 and the electron gun 3. Accordingly, it is impossible to focus the three electron beams onto the fluorescent film 2, and the resulting misconvergence among the electron beams in turn results in misregistration of color on the fluorescent film 2.

This color misregistration considerably degrades the quality of images in a computer display. In order to prevent images from being degraded, the deflecting yoke 4 is set around the bulb 1 in a conventional cathode ray tube. A test pattern is displayed on the fluorescent film 2, and deflected magnetic fields generated by the deflecting yoke 4 are compensated for, so that the test pattern is displayed in a desired shape and in a desired color, and the generated images have no color misregistration.

Many attempts have been made to compensate for deflected magnetic fields. For instance, Japanese Unexamined Patent Publication No. 55-157846 suggests the deflecting yoke illustrated in FIG. 2. In the illustrated deflecting yoke, four magnetic pieces 9 are secured onto an outer surface of a bobbin 5. The magnetic pieces 9 are composed of iron alloy containing nickel as a principle ingredient (commercially available in the tradename of "PERMALLOY") and are equally spaced around the circumference of the bobbin 5. The magnetic pieces 9 improve coma-aberration on a screen, and compensate for color misregistration horizontally and vertically in three primary colors, red (R), blue (B), and green (G), as illustrated in FIG. 3.

Japanese Unexamined Patent Publication No. 8-115686 suggests a deflecting yoke for misconvergence. In the suggested deflecting yoke, illustrated in FIG. 4 , magnetic pieces 10 composed of magnetic material having high magnetic permeability, such as silicon steel and "PERMALLOY," are attached to an outer surface of the bobbin 5 in such a manner that the magnetic pieces are movable around the circumference of the bobbin 5.

Japanese Unexamined Patent Publication No. 9-45261 suggests a deflecting yoke as illustrated in FIG. 5. The illustrated yoke is formed with four slide rails 12 diagonally positioned reletive to the bobbin 5 at a rear end of the yoke. A magnetic piece 11 is supported along the slide rail 12. The magnetic pieces 11 are composed of silicon steel containing 3% silicon, or magnetic materials such as ferrite and amorphous providing the same effects as those of silicon steel. A part of the magnetic flux leaking out of the deflecting yoke is cut off by appropriately adjusting the magnetic pieces 11. As a result, a profile of magnetic flux density in the bulb 1 is adjusted, improving deformation of images.

As explained above, the conventional deflecting yokes can improve image deformation and/or color-misregistration that result from misconvergence.

If, as illustrated in FIG. 6A, a horizontally deflected magnetic field is asymmetrically distributed in the bulb 1 due to a dispersion in the shape in the windings of the first and second coils 6 and 7, a dispersion in location of the first and second coils 6 and 7 when secured to the bobbin 5, a gap between axes of the electron gun 3 and neck portion 1*c,* and/or a gap between axes of the deflecting yoke 4 and the electron gun 3, then a magnetic flux density in a horizontal direction also becomes asymmetrical, as illustrated in FIG. 6B with a solid line X1. Forces exerting on the electron beams R, G, and B also become asymmetric as a result.

Hence, an electron beam located at a distance S from the center at the right side receives a force from a magnetic field, a force which differs in magnitude from a force received by another electron beam located at the same distance from the center at the left side, and misconvergence is generated on the fluorescent film 2 between a central electron beam G and the other two electron beams 13B and 13R, as illustrated in FIG. 2C. In order to eliminate this misconvergence, it is necessary to adjust a profile of deflected magnetic flux in such a manner that a green bright line 13G, which is a reference line, is made closer to a bright blue line 13B or a red bright line 13R located inside or outside the green bright line 13G.

A horizontally deflected magnetic field is partially leaked outside the deflecting yoke 4. Therefore, if a magnetic piece having high magnetic permeability is positioned as a compensator in a leaked magnetic field at a rear of the deflecting yoke 4, the leaked magnetic flux is partially cut off, compensating for a profile of the magnetic flux in the bulb 1.

By moving the magnetic piece as a compensator, a profile of the magnetic flux density is differentially varied horizontally around the center when viewed from the panel 1*b*. As a result, the electron beams located at the distance S from the center receive the same magnitude force, which ensures elimination of misconvergence.

If a horizontally deflected magnetic flux is distributed asymmetrically out of a curve of the second order, as illustrated in FIG. 7A, misconvergence is generated between two electron beams sandwiching a central electron beam therebetween, as illustrated in FIG. 7B.

As illustrated in FIG. 7B, the blue and red electron beams, which sandwich a central electron beam, project two rectangles on the screen. A side of a rectangle overlaps a side of another rectangle, and the two rectangles cooperate with each other to put the red and blue bright lines 13R and 13B in optimal condition. However, vertical bright lines 13R and 13B located at a center of the screen are out of position.

In such a condition, even if a magnetic piece having high permeability is put in a leaked magnetic field and moved therein to vary a profile of a magnetic flux density in a bulb, it would be impossible to adjust a profile of magnetic flux density to be horizontally symmetric on a screen. If bright lines located at the center of the screen are overlapped, bright lines 13R and 13B, located at opposite sides, are offset with each other. As a result, any such adjustment ends up with the bright lines located at the opposite sides being incorrectly balanced.

In light of these problems, miconvergence can only be completely eliminated by means of other compensators (not illustrated) secured to the bulb, which brings about more problems with complicated adjustments and an increase in the number of compensation steps.

SUMMARY OF THE INVENTION

It is an object of the present invention to provide a cathode ray tube which is capable of compensating for misconvergence without complicated adjustments and an increase in the number of compensation steps.

There is provided a cathode ray tube including (a) a panel having fluorescent film on an inner surface thereof for emission of three primary colors, (b) an electron gun for emitting electron beams to the fluorescent film, (c) a deflecting yoke located between the panel and the electron gun, including first and second coils for generating horizontally and vertically deflected magnet fields, (d) at least one first compensator composed of magnetic substance having high magnetic permeability and low hysteresis characteristic for compensating for a profile of magnetic flux density in the horizontally deflected magnetic field, and (e) at least one second compensator composed of magnetic substance having hysteresis characteristic for keeping magnetization when a polarity of the horizontally deflected magnetic field is inverted.

The first compensator may be designed to compensate for misconvergence generated between a central electron beam and two electron beams between which the central electron beam is situated. The second compensator may be designed to compensate for misconvergence generated between the two electron beams.

The first and second compensators may be fixed on an outer surface of the deflecting yoke. It is preferable that the second compensator be composed of silicon steel, specifically, non-oriented silicon steel.

There is further provided a cathode ray tube including (a) a panel having fluorescent film on an inner surface for emitting three primary colors, (b) an electron gun for emitting electron beams to the fluorescent film, (c) a deflecting yoke located between the panel and the electron gun, including first and second coils for generating horizontally and vertically deflected magnet fields, (d) at least one first compensator composed of magnetic substance having high magnetic permeability and low hysteresis characteristic for compensating for a profile of magnetic flux density in the horizontally deflected magnetic field, the first compensator adapted for radial movement relative an axis of the deflecting yoke, and (e) at least one second compensator composed of magnetic substance having hysteresis characteristic for keeping magnetization when a polarity of the horizontally deflected magnetic field is inverted, the second compensator adapted for radial movement relative the axis of the deflecting yoke.

It is preferable that the first and second compensators are spaced away from each other along the axis of the deflecting yoke.

The cathode ray tube may include a compensator holder comprised of a pair of walls standing facing each other on an outer surface of the deflecting yoke, and first and second grooves on the inner surface arranged in a vertical relationship to each other, and extending along the radius of the deflecting yoke. The first and second compensators are supported at opposite edges by sliding them into the first and second grooves. It is preferable that an additional compensator holder stands on an outer surface of the deflecting yoke, supporting an additional set of first and second compensators. The additional compensator holder may be located symmetrical to the first compensator holder around a center of the deflecting yoke.

It is preferable that a plurality of compensator holders stands on an outer surface of the deflecting yoke, and that the plurality of compensator holders are equally spaced around the circumference of the deflecting yoke, or that the plurality of compensator holders are symmetrical to one another about a center of the deflecting yoke.

It is preferable that a plurality of compensator holders stands on an outer surface of the deflecting yoke in such a manner that the compensator holders are located adjacent to one another.

It is also preferable that a plurality of compensator holders stands on an outer surface of the deflecting yoke in such a manner that the compensator holders are parallel to each other.

The deflecting yoke may be formed with a flange extending radially of the deflecting yoke, wherein the flange is formed with a radially extending slit. The first and second compensators have grooves formed at the opposite edges in such a manner that the inner edges of the slit are able to fit into the grooves.

In this cathode ray tube, misconvergence generated at vertical bright lines located at opposite sides on a screen can be eliminated by means of a simple solution, and highly qualified images can be provided on a screen without color-misregistration.

The above and other objects and advantageous features of the present invention will be made apparent from the following description, which references the accompanying figures.

DESCRIPTION OF THE PREFERRED EMBODIMENTS

Figure 1:
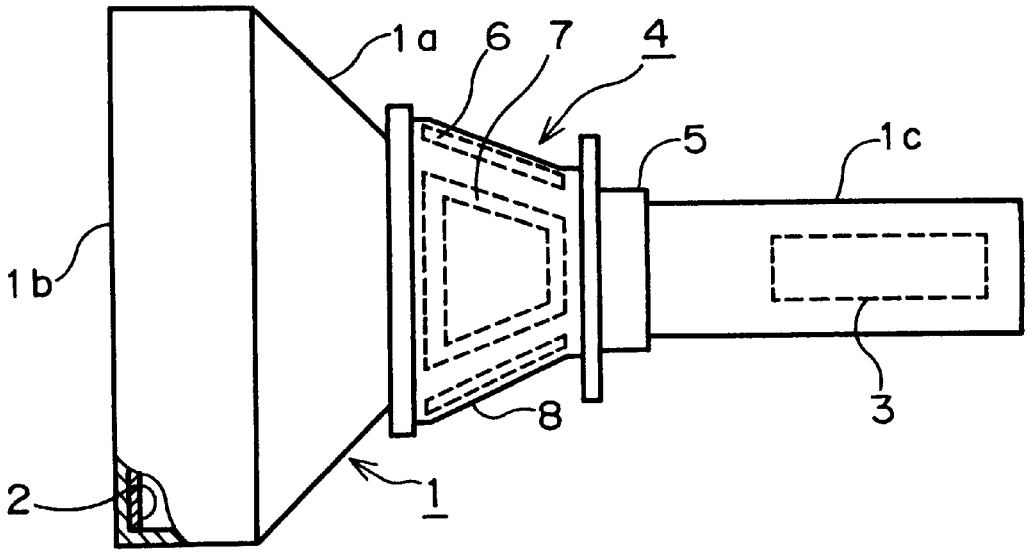
FIG. 1 PRIOR ART
FIG. 1 is a side view and partial cross-section of a conventional color cathode ray tube.
Figure 2:
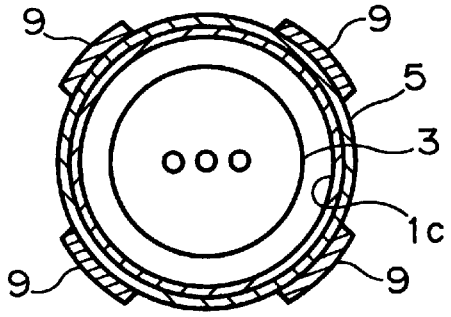
FIG. 2 PRIOR ART
FIG. 2 is a cross-section view of a neck portion of the color cathode ray tube in FIG. 1, around which misconvergence compensators are arranged.
Figure 3:
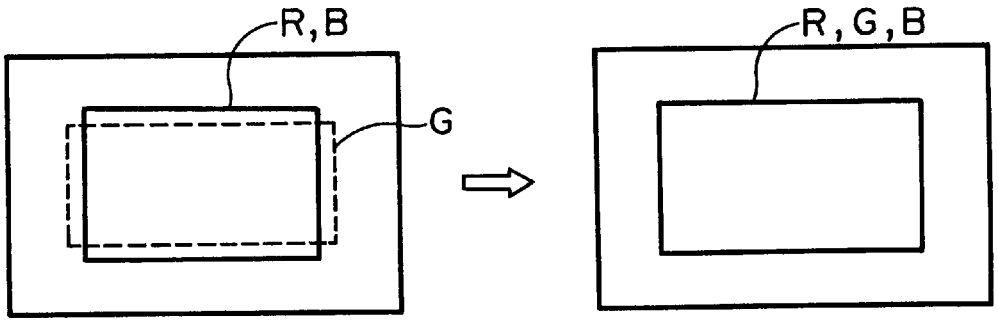
FIG. 3 PRIOR ART
FIG. 3 is a front view of a panel, showing that misconvergence is compensated for by means of the compensators illustrated in FIG. 2.
Figure 4:
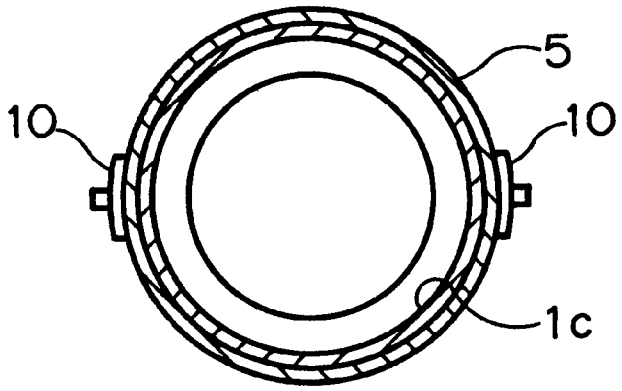
FIG. 4 PRIOR ART
FIG. 4 is a cross-section of another conventional cathode ray tube, around which other misconvergence compensators are arranged.
Figure 5:
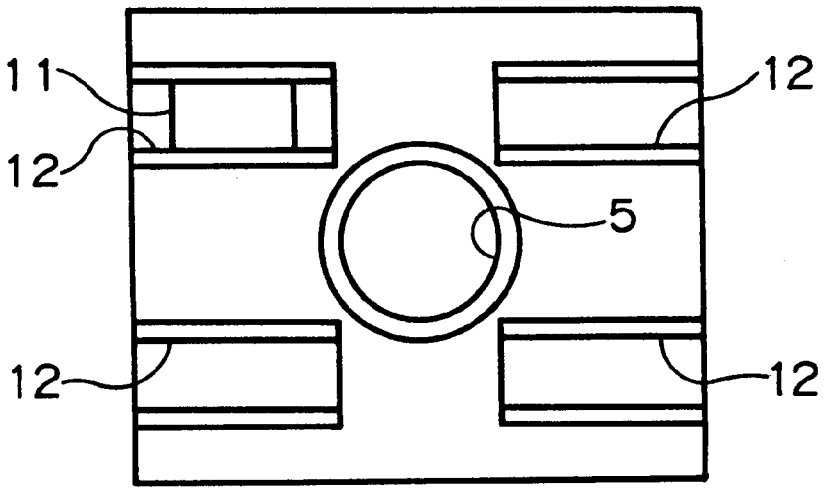
FIG. 5 PRIOR ART
FIG. 5 is a cross-section of a neck portion of still another conventional cathode ray tube, around which other misconveregence compensators are arranged.
Figure 6A:
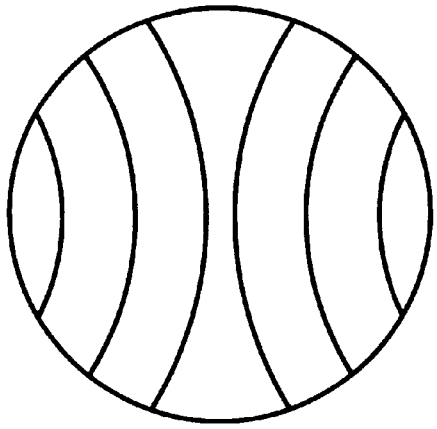
FIG. 6 A PRIOR ART
FIG. 6A illustrates a profile of a magnetic field in a bulb.
Figure 6B:
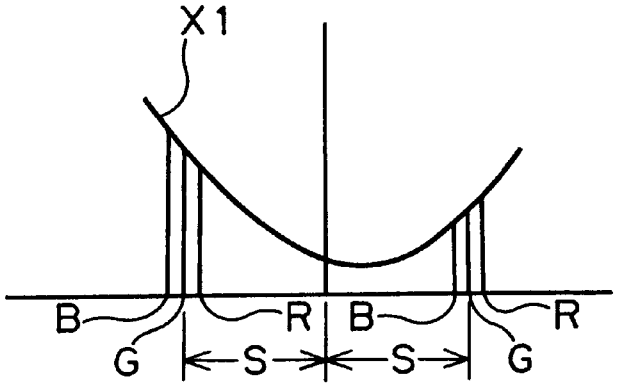
FIG. 6 B PRIOR ART
FIG. 6B illustrates a profile of a magnetic flux density in a bulb.
Figure 6C:
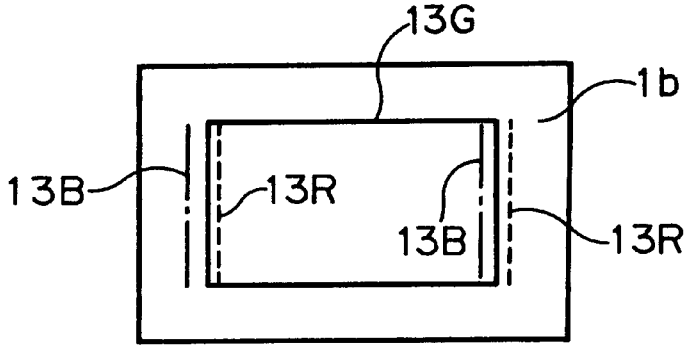
FIG. 6 C PRIOR ART
FIG. 6C illustrated images displayed on a panel.
Figure 7A:
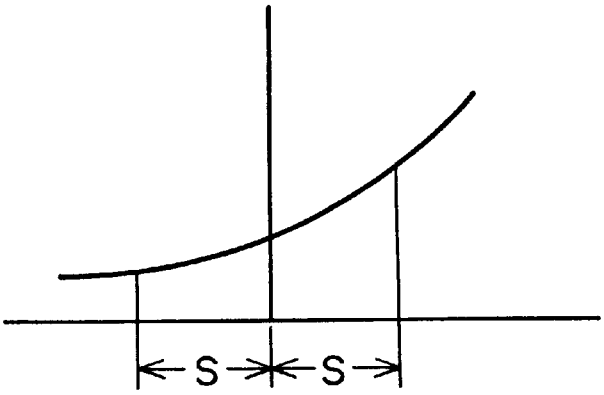
FIG. 7 A PRIOR ART
FIG. 7A illustrates another profile of a magnetic flux density in a bulb.
Figure 7B:
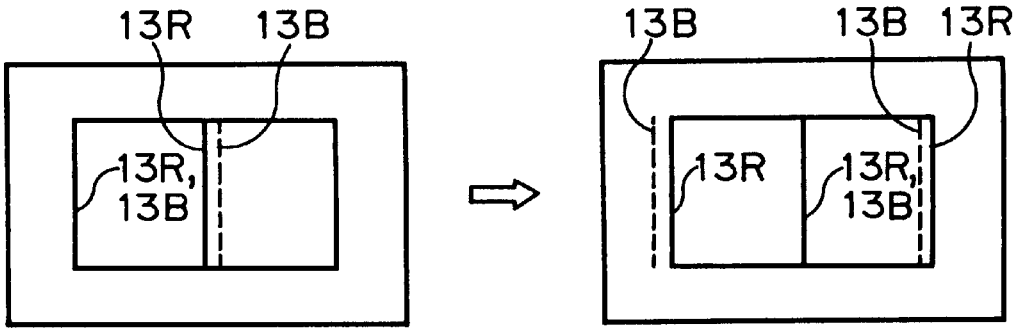
FIG. 7 B PRIOR ART
FIG. 7B illustrates another image displayed on a panel.
Figure 8:
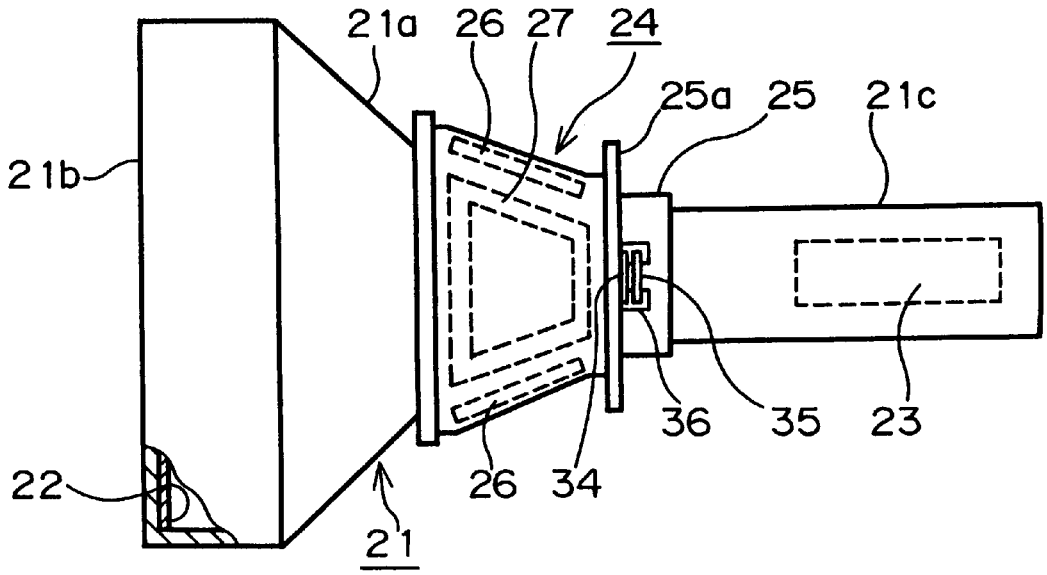
FIG. 8 is a side view and partial cross-section of a color cathode ray tube in accordance with a preferred embodiment of the present invention.

FIG. 8 illustrates a cathode ray tube in accordance with a preferred embodiment of the present invention.

The color cathode ray tube in accordance with the present embodiment includes a bulb 21, comprised of a panel 21*b*, a neck portion 21*c*, and a funnel 21*a* with a truncated-conical cross-section, connecting the panel 21*b* and the neck portion 21*c* with each other.

A fluorescent film 22 is applied to an inner surface of the panel 21*b*. The fluorescent film 22 includes materials for emitting three primary colors, which are separated from one another with photo-absorbing material sandwiched therebetween.

An in-line type electronic gun 32 is installed in the neck portion 21*c*, emitting three electron beams (not illustrated) to the fluorescent film 22, producing three primary colors.

A deflecting yoke 24 is secured to the bulb 21 over the funnel portion 21*a*, and the neck portion 21*c*. The deflecting yoke 24 is comprised of a bobbin 25 having a truncated-conical cross-section and formed with a flange 25*a*, a first coil 26 wound around the bobbin 25 for vertically deflecting a magnetic field, a second coil 27 wound around the bobbin 25 for vertically deflecting a magnetic field, and a ferrite core 28 applied on an outer surface of the bobbin 25.

In operation, the electron gun 23 horizontally emits three parallel electron beams, and deflects two electron beams sandwiching a central electron beam in such a manner that those two electron beams converge to the central electron beam. Sawtooth current is supplied to each of the first and second coils 6 and 7, thereby generating horizontally and vertically deflected magnetic fields.

The three electron beams emitted from the electron gun 3 enter the deflected magnetic fields, and are deflected to a degree proportional to the intensity of the magnetic fields. The deflected electron beams then converge onto the fluorescent film 22, and cause the fluorescent film 22 to emit lights as a result. Thus, colored images appear on the panel 21*b*.

The cathode ray tube in accordance with the present embodiment is characterized by a first compensator 34, and a second compensator 35, both located where a magnetic field is leaked from the first coil 26, specifically, at the flange 25*a* formed with the bobbin 25 at an end closer to the electron gun 23. The first and second compensators are designed to be movable radially relative to the bobbin 25.

The first compensator is composed of magnetic substance having high magnetic permeability and low hysteresis characteristic. For instance, the first compensator 34 is composed of iron alloy commercially available under the tradename of "PERMALLOY." The second compensator is composed of magnetic substance having hysteresis characteristic ensuring high coercive force. For instance, the second compensator 35 is composed of nonoriented silicon steel. The first and second compensators 34 and 35 are fabricated in rectangular plates.

Figure 9:
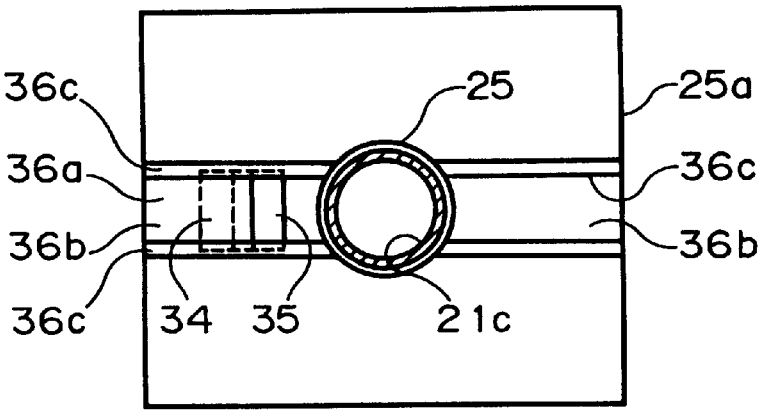
FIG. 9 is a rear view of a bobbin in the cathode ray tube illustrated in FIG. 8.
Figure 10:
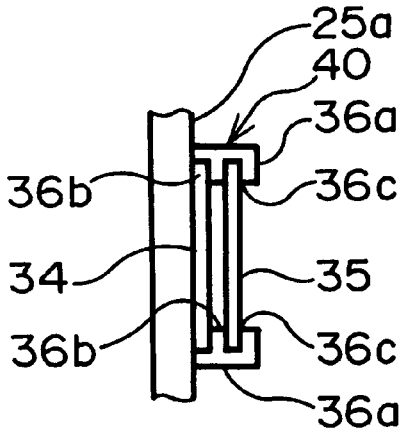
FIG. 10 is a side view of a misconvergence compensator secured to a bobbin.

As illustrated in FIGS. 9 and 10, a pair of compensator holders 40 are formed on a surface of the flange 25*a* for enabling the first and second compensators 34 and 35 to move radially relative to the bobbin 25. As illustrated in FIG. 9, the compensator holders 40 are positioned symmetrically around the bobbin 25.

As illustrated in FIG. 10, each of the compensator holders 40 includes a pair of walls standing facing each other on a surface of the flange 25*a*. Each wall 36*a* has first and second grooves 36*b* and 36*c* on the inner surface arranged in a vertical relationship to each other. The first and second grooves 36*b* and 36*c* extend radially from the bobbin 25. The first and second compensators 34 and 35 are supported at opposite edges by sliding them into the first and second grooves 36*b* and 36*c*.

The compensator holders 40 are formed on the flange 25*a* so that they extend horizontally around the bobbin 25. In the present embodiment, as illustrated in FIG. 9, the first and second compensators 34 and 35 are carried at only one of the compensator holders 40. However, the first and second compensators 34 and 35 may be provided at both the compensator holders 40.

The color cathode ray tube adjusts convergence among the three electron beams at a center of the fluorescent film 22 by means of the deflecting yoke 24, and other aids (not illustrated). There still remains misconvergence at opposite sides of the fluorescent film due to a dispersion in dimensions and the shape of the electron gun 23 and the deflecting yoke 24, and a dispersion in accuracy in assembling the cathode ray tube.

Figure 11:
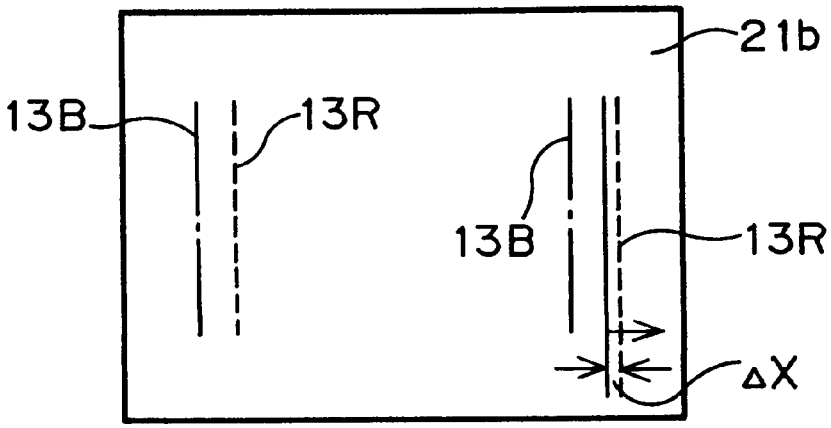
FIG. 11 is a front view of a panel, illustrating how misconvergence is eliminated in accordance with the present invention.

The cathode ray tube, in accordance with the present embodiment, emits two electron beams for red and blue onto the panel 21*b,* thereby forming bright line patterns 13R and 13B, each in the form of a vertical line, as illustrated in FIG. 11. Misconvergence still remains.

It is supposed here that the red and blue bright lines 13R and 13B are positioned in a place at a left side of a panel 21*b,* but the red bright line 13R is out of place by 0.2 mm (Δx) to the right at the right side of the panel 21*b*.

Figure 12:
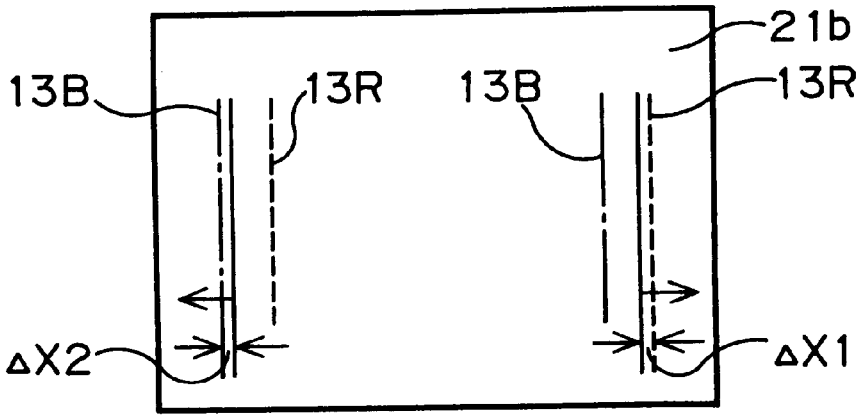
FIG. 12 is a front view of a panel, illustrating how misconvergence is eliminated in accordance with the present invention.

Under this condition, the second compensator 15 is secured to the bobbin 25 at one of the compensator holders 40. Because the second compensator 15 has hysteresis characteristic, it is still magnetized by virtue of a coercive force, even if a deflected magnetic field is inverted. Thus, even if a profile of a magnetic flux density is asymmetric on the panel 21*b,* it would be possible to make the profile of a magnetic flux density almost symmetric on the panel 21*b* by appropriately positioning the second compensator 35, as illustrated in FIG. 12.

The second compensator is movable radially relative to the bobbin 25 so that an absolute value of a discrepancy of the red bright line 13R at the right side of the panel 21*b* is equal to an absolute value of a discrepancy of the bright blue line 13B at the left side of the panel 21*b*. Referring to FIG. 12 for exemplary purposes, the red bright line 13R is moved to the right by 0.15 mm (Δx1), and the bright blue line 13B is made to move to the left by 0.15 mm (Δx2).

Next, three electron beams are emitted onto the fluorescent film 22, forming red, blue, and green bright lines at opposite sides of the panel 21*b*. Then, the first compensator 34 is secured to the bobbin 25 at the compensator holder 40, and is adjusted with respect to the position of the bobbin 25.

Figure 13:
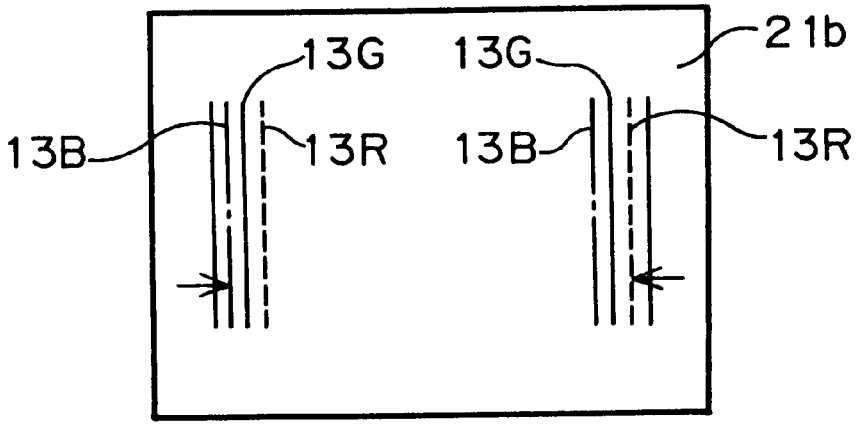
FIG. 13 is a front view of a panel, illustrating how misconvergence is eliminated in accordance with the present invention.

Because the first compensator 34 is composed of magnetic substance having a high magnetic permeability, such as "PERMALLOY", the first compensator 34 partially cuts off a leaked magnetic field, horizontally displacing a profile of a magnetic flux density. In this manner, the first compensator 34 can make the red and blue bright lines 13R and 13B, located at the opposite sides of the panel 21*b,* closer to or further away from the green bright line 13G located at the center of the panel 21*b*. In the example above, the red bright line 13R located at the right of the panel 21*b,* and the blue bright line 13B located at the left of the panel 21*b* are both displaced closer to the green bright line 13G, located at the center of the panel 21*b*. As illustrated in FIG. 13, it is possible to eliminate misconvergence among the three electron beams all over the panel 21*b*.

As explained above, the cathode ray tube according to the present embodiment can make it possible to readily eliminate misconvergence caused by asymmetry in a profile of a magnetic flux density in the panel 21*b,* and the bright lines can be completely compensated for at both the right and left sides of the panel 21*b*.

Figure 14:
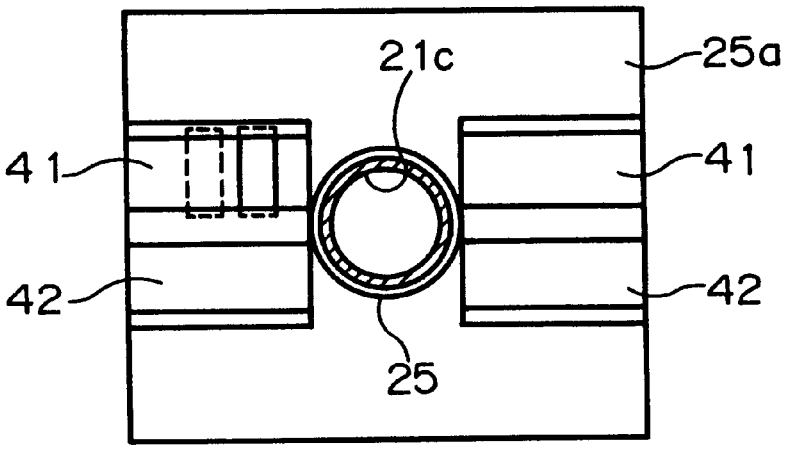
FIG. 14 is a rear view of a bobbin to which misconvergence compensators are secured.

In the present embodiment, the first and second compensators 34 and 35 are supported along their axes in the compensator holder 40. However, it should be noted that a plurality of compensator holders may be formed on the flange 25*a* so that two of the compensator holders 41 and 42 are located parallel with a certain distance from the bobbin 25 and adjacent to each other, as illustrated in FIG. 14. The first compensator 34 is supported in one of the compensator holders 41, and the second compensator in compensator holder 42.

Figure 15:
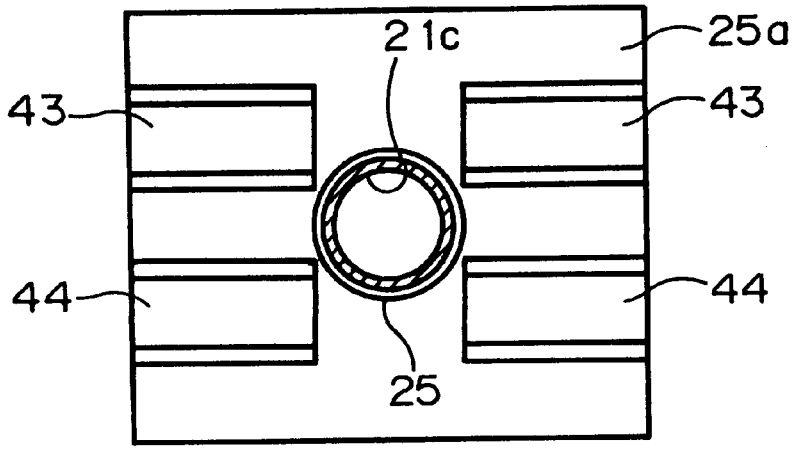
FIG. 15 is rear view of a bobbin to which misconvergence compensators are secured.

As an alternative, compensator holders 43 and 44 may be parallel to each other and spaced apart, as illustrated in FIG. 15.

Figure 16:
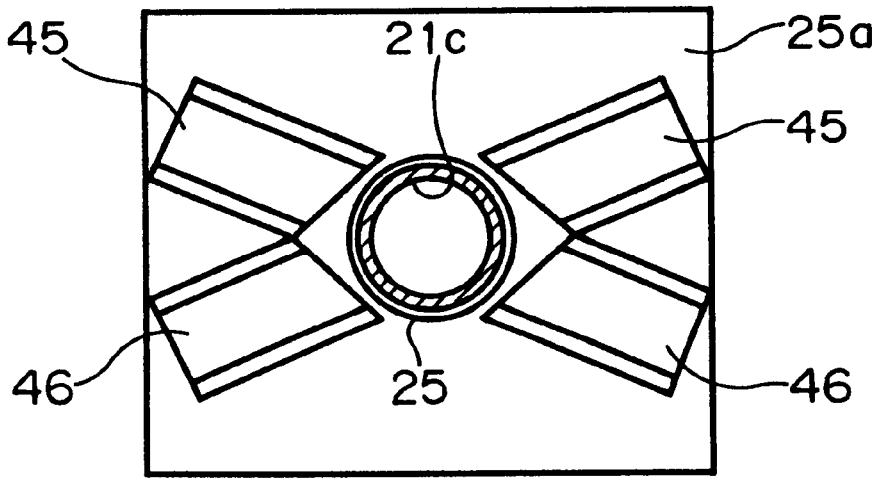
FIG. 16 is a rear view of a bobbin to which misconvergence compensators are secured.

When a plurality of compensator holders are secured to the flange 25*a,* the compensator holders 45 and 46 may be located radially from the bobbin 25, as illustrated in FIG. 16. The compensator holders 45 and 46 may also be arranged symmetrically to the bobbin, or equally spaced around the circumference of the bobbin 25.

Figure 17:
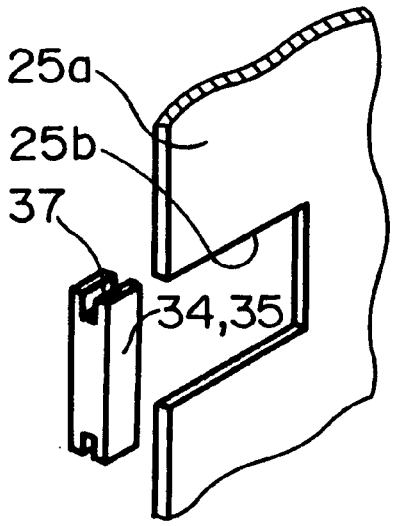
FIG. 17 is a perspective view illustrating a misconvergence compensator to be secured to a bobbin.

FIG. 17 illustrates another way of supporting the first and second compensators 34 and 35, while allowing them to slide. The flange 25*a* is formed with a radially extending slit 25*b,* as illustrated in FIG. 17. The first and second compensators are formed with grooves 37 at the opposite edges, having a width equal to or slightly greater than a thickness of the flange 25*a*. The inner edges of the slit 25*b* fit into the grooves 37, ensuring that the first and second compensators 34 and 35 move radially relative to the bobbin 25.

Alternatively, the first and second compensators 34 and 35 may be fixed to the flange 25*a* using another medium, such as an adhesive.

While the present invention has been described in connection with certain preferred embodiments, the subject matter encompassed by the present invention is not to be limited to those specific embodiments. In fact, the subject matter of the invention is intended to include all alternatives, modification, and equivalents that can be included within the spirit and scope of the following claims.

What is claimed is:

1. A cathode ray tube comprising:

(a) a panel having a fluorescent film on an inner surface thereof for three primary colors emission;

(b) an electron gun for emitting electron beams to said fluorescent film;

(c) a deflecting yoke located between said panel and said electron gun, and including first and second coils for generating horizontally and vertically deflected magnet fields;

(d) at least one first compensator composed of magnetic substance having high magnetic permeability and low hysteresis characteristic for compensating for a profile of magnetic flux density in said horizontally deflected magnetic field, said first compensator being movable radially of said deflecting yoke; and (e) at least one second compensator composed of magnetic substance having hysteresis characteristic for keeping magnetization when a polarity of said horizontally deflected magnetic field is inverted, said second compensator being movable radially from said deflecting yoke.

2. The cathode ray tube as set forth in claim 1, wherein said first compensator compensates for misconvergence generated between a central electron beam and two electron beams between which said central electron beam is situated, and wherein said second compensator compensates for misconvergence existing between said two electron beams.

3. The cathode ray tube as set forth in claim 1, wherein said first and second compensators are spaced away from each other axially of said deflecting yoke.

4. The cathode ray tube as set forth in claim 1, wherein said second compensator is composed of silicon steel.

5. The cathode ray tube as set forth in claim 4, wherein said second compensator is composed of non-oriented silicon steel.

6. The cathode ray tube as set forth in claim 1, further comprising at least one compensator holder including a pair of walls standing in facing relation on an outer surface of said deflecting yoke and formed at inner surfaces thereof with first and second grooves arranged in a heightwise direction thereof and extending radially of said deflecting yoke, said first and second compensators being slidably supported at opposite edges thereof with said first and second grooves.

7. The cathode ray tube as set forth in claim 6, further comprising an additional compensator holder standing on an outer surface of said deflecting yoke.

8. The cathode ray tube as set forth in claim 7, further comprising another first and second compensators carried at said additional compensator holder.

9. The cathode ray tube as set forth in claim 7, wherein said additional compensator holder is located symmetrically with said compensator holder about a center of said deflecting yoke.

10. The cathode ray tube as set forth in claim 6, wherein a plurality of compensator holders stands on an outer surface of said deflecting yoke.

11. The cathode ray tube as set forth in claim 9, wherein said plurality of compensator holders is located equally, circumferentially about said deflecting yoke.

12. The cathode ray tube as set forth in claim 9, wherein said plurality of compensator holders is located symmetrically with one another about a center of said deflecting yoke.

13. The cathode ray tube as set forth in claim 6, wherein a plurality of compensator holders stands on an outer surface of said deflecting yoke in such a manner that said compensator holders are located adjacent to one another.

14. The cathode ray tube as set forth in claim 6, wherein a plurality of compensator holders stands on an outer surface of said deflecting yoke in such a manner that said compensator holders are spaced in parallel away from each other.

15. The cathode ray tube as set forth in claim 1, wherein said deflecting yoke is formed with a flange extending radially from said deflecting yoke, and said flange is formed with a radially extending slit, said first and second compensators being formed at opposite edges thereof with grooves in such a manner that inner edges of said slit are fittable into said grooves.

* * * * *